US005178212A

United States Patent [19]

Nakamura

[11] Patent Number: 5,178,212

[45] Date of Patent: Jan. 12, 1993

[54] PLATE-TYPE HEAT EXCHANGER

[75] Inventor: Junichi Nakamura, Hirakata, Japan

[73] Assignee: Hisaka Works Limited, Osaka, Japan

[21] Appl. No.: 761,370

[22] PCT Filed: Feb. 18, 1991

[86] PCT No.: PCT/JP91/00203

§ 371 Date: Sep. 19, 1991

§ 102(e) Date: Sep. 19, 1991

[87] PCT Pub. No.: WO91/13310

PCT Pub. Date: Sep. 5, 1991

[30] Foreign Application Priority Data

Feb. 21, 1990 [JP] Japan ..... 2-41758
Apr. 17, 1990 [JP] Japan ..... 2-102104

[51] Int. Cl.[5] ..... F28F 3/10

[52] U.S. Cl. ..... 165/166; 165/167

[58] Field of Search ..... 165/166, 167; 277/181, 277/189

[56] References Cited

U.S. PATENT DOCUMENTS

| | | | |
|---|---|---|---|
| 4,377,204 | 3/1983 | Johansson | 165/166 |
| 4,635,715 | 1/1987 | Andersson | 165/166 |
| 4,905,758 | 3/1990 | Mathur et al. | 165/166 |
| 4,995,455 | 2/1991 | Mathur | 165/166 |
| 5,070,939 | 12/1991 | Mathur | 165/166 |

*Primary Examiner*—John Rivell
*Assistant Examiner*—L. R. Leo
*Attorney, Agent, or Firm*—Nikaido, Marmelstein, Murray & Oram

[57] ABSTRACT

A plate-type heat exchanger comprises a plurality of plates laminated through gaskets fixed in gasket grooves formed in the entire peripheral edges thereof without using any adhesive agent. The liquid-noncontacted peripheral side surface of the gasket body of the gasket is integrally formed with suitably spaced fixing tabs each comprising a plurality of projecting pieces projecting from the gasket body, and at least a fixing piece extending parallel with the gasket body. The plate is formed with gasket fixing portions associated with the fixing tabs of the gasket for fixing the fixing tabs by force-fitting the fixing pieces of the fixing tabs in slits extending parallel with the gasket groove. The gasket fixing tabs may be integrally formed with fixing pieces interconnecting adjacent projecting pieces or with suitably spaced L-shaped fixing tabs each comprising a projecting piece projecting from the gasket body and a fixing piece extending parallel with the gasket body and integrally connected to the front end of the projecting piece. The plate gasket fixing concave portions are formed wider than the gasket projecting pieces to loosely accommodate the projecting pieces with room for freedom of lateral movement.

4 Claims, 6 Drawing Sheets

FIG.1
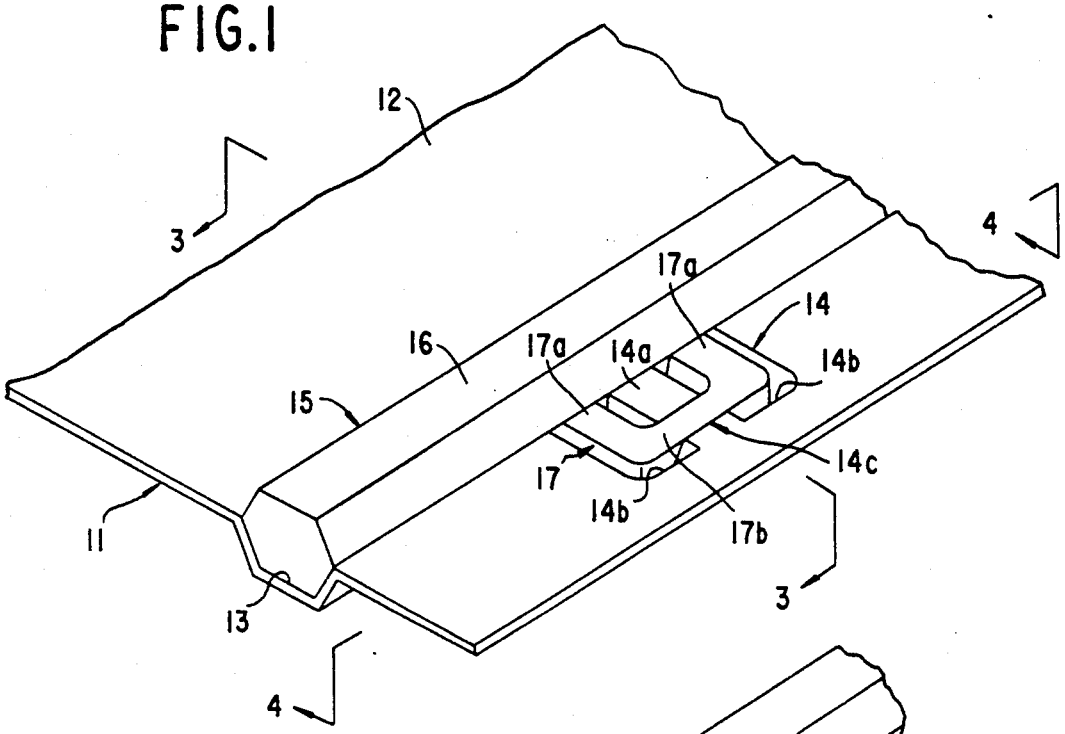
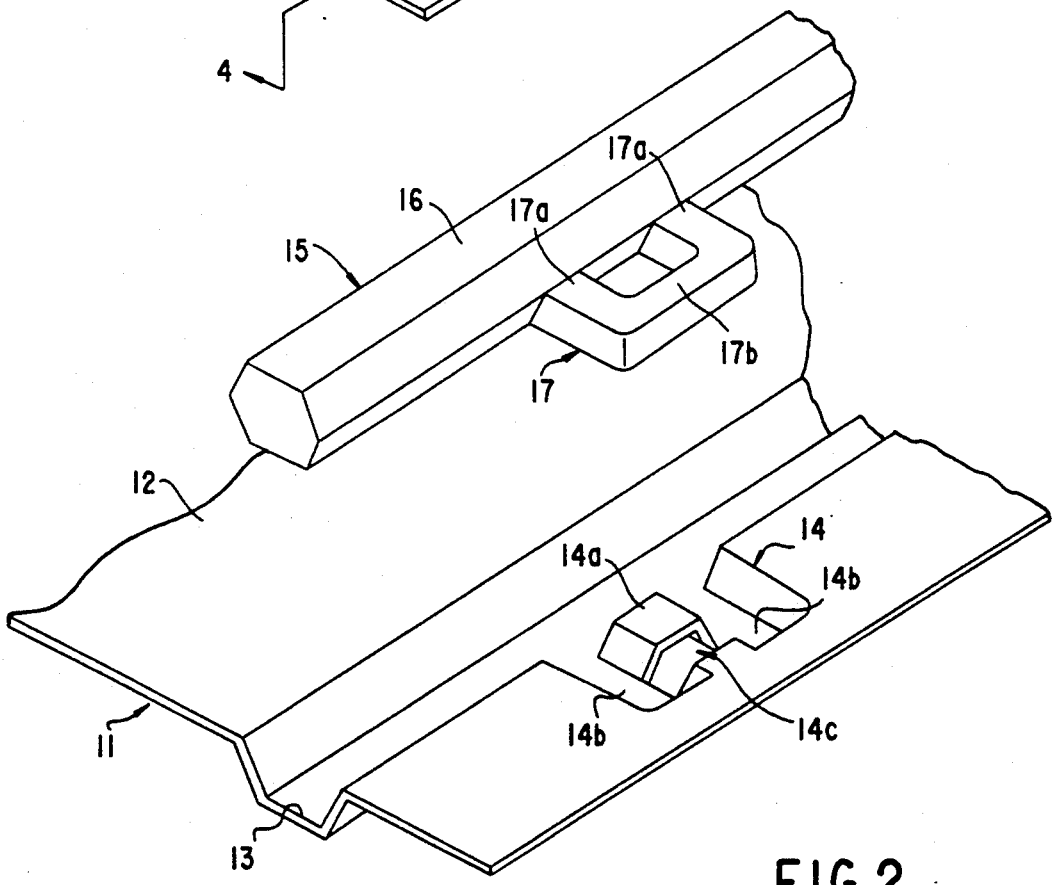
FIG.2

PLATE-TYPE HEAT EXCHANGER

BACKGROUND ART

This invention relates to a plate-type heat exchanger comprising a required number of plates laminated through gaskets and is used in the fields of food and medicines where the use of an adhesive agent should be avoided in attaching the gaskets to the plates and in the field of general chemistry where improvements in gasket replacement maintenance is desired.

Generally, a plate-type heat exchanger comprises a required number of plates each having a heat transfer surface formed with a suitable unevenness pattern, said plates being laminated through gaskets to define a plurality of channels between adjacent plates, with two types of mediums flowing through alternate channels.

FIG. 9 is a partial perspective view showing a concrete example of a typical plate-type heat exchanger, wherein the numeral 1 denotes plates each having a heat transfer surface 2 with a suitable unevenness pattern (not shown) and having holes 3, 4, 5, 6 at four corners, and gaskets 7 of synthetic rubber or other elastic material having heat resistance are mounted, each gasket surrounding the associated heat transfer surface 2 in such a manner as to establish communication between the holes 3 and 4 and close the other holes 5 and 6. A required number of such plates 1 are alternately turned upside down and laminated to define a channel 8 for a medium a and a channel 9 for a medium b.

In such plate-type heat exchanger, as shown in FIG. 10, the gasket 7 is fitted in a gasket groove 10 formed in the peripheral edge of the plate 1. The plates 1 are laminated, whereby the gaskets 7 are pressed against the rear surfaces of the gasket grooves 10 of adjacent plates 1 to define sealed channels 8 and 9 between the plates 1, thus forming a sealing construction which prevents the mediums from leaking outside.

Heretofore, it has been common practice to fix said gaskets in the gasket grooves 10 by an adhesive agent. That is, since such adhesive agent suitably fixes the gaskets 7 in the gasket grooves 10 but allows the relatively easy removal of the gaskets when it is necessary to replace them, it has been generally used for fixing the gaskets in the gasket groove 10. When it is desired to adhesively fix the gaskets 7 in the gasket grooves 10 of the plates 1, however, it is necessary to wash the oil and grease and other extraneous substances, which hinder adhesion, off the surfaces of the plates 1 in advance of application of an adhesive agent. Further, application, drying and aging of an adhesive agent take time and there has been a need for maintenance operation including careful cleaning of the old adhesive agent off the gasket grooves 10 in advance of adhesion of fresh gaskets 7 to replace the old gaskets 7. Besides this, in the case where heat exchange is effected for fluids for food and medicines, migration of an adhesive agent sometimes becomes a problem. Therefore, it has been desired to fix the gaskets 7 in the gasket grooves 10 of the plates 1 without using any adhesive agent.

According to a known arrangement for attaching the gaskets 7 to the gasket grooves 10 without using any adhesive agent, as shown in FIGS. 11 through 13, fixing tabs **7*b* are integrally fixed at suitable intervals to the liquid-noncontacted peripheral side surface of the gasket body of a gasket 7 and a fixing projection 7*c* is integrally fixed to each fixing tab 7*b*, while the liquid-noncontacted peripheral side surface of each gasket groove 10 of the plate 1 is recessed to form a gasket fixing insertion portion 10*a* corresponding to said fixing tab 7*b* and the bottom of said gasket fixing insertion portion 10*a* is formed with a fitting hole 10*b* associated with said fixing projection 7*c* to receive the latter, said fixing projection 7*c* of said tab 7*b* being force-fitted in said fitting hole 10*b* of the fixing insertion portion 10*a*, thereby fixing the gasket 7 to the gasket groove 10 of the plate 1**.

According to the means described above, the fixing of the gasket 7 to the gasket groove 10 of the plate 1 without using any adhesive agent becomes possible, but there has been the following problem.

The material for gaskets to be used in plate-type heat exchangers is suitably selected according to the temperature, pressure and liquids to be used. Thus, many gasket materials have been required and used.

First, in the case of a gasket 7 which is made of an elastic material having heat resistance, such as synthetic rubber, since the amount of shrinkage taking place during manufacture due to difference in material, if the same metal mold is used to produce gaskets of synthetic rubber, the length always differs. Even if the same material is used, when the production lot differs, a scatter occurs in the length of the gasket body **7*a*; furthermore, such dimensional scatter is not constant on the entire periphery of the gasket body 7*a* but takes place locally. Therefore, in the case of the conventional gasket 7 in which the fixing point of the fixing tab 7*b* is set at a single point, the scatter in the length of the gasket body 7*a* cannot be accommodated in the fixing operation. Therefore, in the case where the gasket body 7*a* of the gasket 7 is long, when the gasket 7 is fixed in the gasket groove 10 of the plate 1, the gasket body 7*a* is locally bent, as shown in FIG. 14 at a, and is raised from the gasket groove 10 of the plate 1, so that when the plates 1 are clamped for lamination, the gasket 7 is not received in the predetermined position in the gasket groove 10 of the plate 1; thus, the sealing property becomes a problem. Further, in the case where the gasket body 7*a* is short, as shown in FIG. 14 at b, the fixing of the gasket 7 in the gasket groove 10 is effected with the fixing tab 7*b* positioned in the bent state in the gasket fixing insertion portion 10*a* of the gasket groove 10. Thus, the operability for fixing the gasket 7 in the gasket groove 10 is degraded, and the gasket body 7*a* is raised from the gasket groove 10 by the bent fixing tab 7*b*, so that when the plates 1 are laminated, the gasket 7 is not received in the gasket groove 10 of the plate 1, offering a problem of sealing quality. Further, since the gasket 7 is merely integrally formed with the fixing tab 7*b* projecting from the gasket body 7*a* with only a limited area of junction, the fixing tab 7*b* has a limited strength, tending to bend with respect to the gasket body 7*a*. Thus, to achieve firm fixing of the gasket 7 in the gasket groove 10 of the plate 1, many fixing tabs 7*b* must be formed with a short pitch, and the plate processing equipment and the gasket processing time are increased, leading to a cost increase. Further, the fixing tab 7*b* of the gasket 7 tends to bend with respect to the gasket body 7*a* and the fixing projection 7*c* is integrally formed with the fixing projection 7*c* on the rear surface of the front end thereof; therefore, when a plurality of gaskets 7 are bundled during manufacture or handling, the fixing tabs 7*b* and fixing projections 7*c* interfere with each other, making handling inconvenient or damaging the fixing tabs 7*b***. Further, since the fixing force created by the force-fit between the fixing projection 7*c* integrally formed on the rear surface of the front end of the fixing tab 7*b* of the gasket 7 and the fitting hole 10*b* formed in the plate 1 is low, the gasket 7 tends to be disengaged from the plate; thus, there has been a problem of sealing quality.

This invention has been accomplished in view of the aforesaid problems to the conventional plate-type heat exchanger and has for its object the provision of a plate-type heat exchanger wherein the operation for fixing gaskets in gaskets grooves in plates is improved and high fixing force is obtained and the gaskets are seldom damaged.

DISCLOSURE OF INVENTION

To achieve said object, this invention provides a plate-type heat exchanger comprising a plurality of plates laminated through gaskets fixed in gasket grooves formed in the entire peripheral edges thereof without using any adhesive agent, said plate-type heat exchanger gasket being formed such that the liquid-noncontacted peripheral side surface of the gasket body of the gasket is integrally formed with a plurality of suitably spaced fixing tabs comprising projecting pieces projecting orthogonally from said gasket body, and a fixing piece extending parallel with said gasket body formed at the end of said projecting pieces, said plate being formed with gasket fixing portions associated with the fixing tabs of said gasket for fixing said fixing tabs by force-fitting the fixing pieces of said fixing tabs in slits extending parallel with said gasket groove. A fixing piece may connect a plurality of fixing tabs. Further, according to this invention, the liquid-noncontacted peripheral side surface of the gasket body of said gasket is integrally formed with suitably spaced L-shaped fixing tabs each comprising a projecting piece projecting from said gasket body and a fixing piece extending parallel with said gasket body and integrally connected to the front end of said projecting piece, said plate being formed with gasket fixing portions associated with the fixing tabs of said gasket for fixing said fixing tabs by force-fitting the fixing pieces of said fixing tabs in slits extending parallel with said gasket groove.

The gasket is fixed to the plate by force-fitting the gasket body in the gasket groove of the plate while force-fitting the fixing pieces on the fixing tabs in slits formed in the plate 1.

According to this invention, since the fixing tabs of the gasket are allowed to have freedom of positioning in a direction parallel with the gasket grooves in the plate, even if there is a scatter in the length of the gasket body during manufacture of gaskets, it can be accommodated at a desired place in the overall length of the gasket during fixing operation. Further, in claim 1 of this invention, since the fixing tab may be formed by connecting two more more projecting pieces extending from the gasket body by a fixing piece, the fixing tab has a much greater strength than the conventional fixing tab merely extending from the gasket body with a small area of junction.

According to this invention, since freedom is imparted to the fixing position of the gasket on the plate, even if there is a scatter in the length of the gasket body during manufacture of the gaskets, this can be accommodated during fixing operation; thus, the operability for fixing the gasket in the gasket groove of the plate is improved and the heat exchanger performance is stabilized. In the invention, since the strength of the fixing tab of the gasket is increased, a great fixing force can be obtained and damage to the fixing tab can be prevented, thereby decreasing the number of defective units.

BRIEF DESCRIPTION OF DRAWINGS

FIGS. 1 through 4 show a first embodiment of the invention.

FIG. 1 is a fragmentary perspective view showing a construction for fixing a plate in a plate-type heat exchanger according to the first embodiment is fixed in position;

FIG. 2 is an exploded perspective view thereof;

FIGS. 3 and 4 are sectional views taken along the lines 3—3 and 4—4 in FIG. 1, respectively.

FIG. 5 is a fragmentary perspective view showing a construction for fixing a gasket in a plate-type heat exchanger according to the second embodiment of the invention;

FIG. 6 is an exploded perspective view thereof; and

FIGS. 7 and 8 are-sectional views taken along the lines 7—7 and 8—8 in FIG. 5, respectively.

FIG. 11 is a fragmentary perspective view;

FIG. 12 is an exploded perspective view; and

FIG. 13 is a sectional view taken along the line 13—13 in FIG. 11.

BEST MODE FOR CARRYING OUT THE INVENTION

Figure 3:
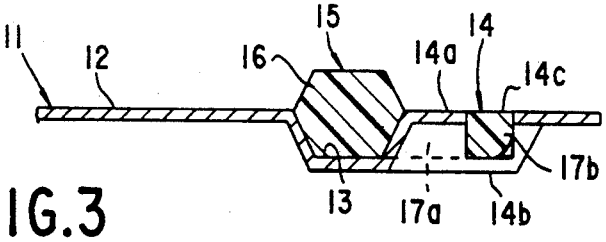
Figure 4:
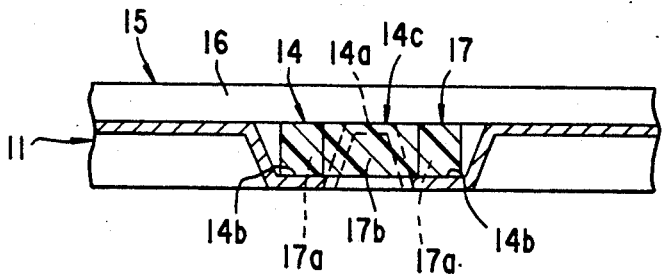

The invention will now be described with reference to embodiments shown in the drawings. FIGS. 1 through 4 show a first embodiment of the invention. FIG. 1 is a fragmentary perspective view showing a construction for fixing a plate in a plate-type heat exchanger according to the first embodiment is fixed in position; FIG. 2 is an exploded perspective view thereof; and FIGS. 3 and 4 are sectional views taken along the lines 3—3 and 4—4 in FIG. 1, respectively.

In FIGS. 1 through 4, the numeral 11 denotes a plate having a heat transfer surface 12 formed with a suitable unevenness pattern (not shown), said plate being formed with a gasket groove 13 of inverted trapezoidal shape along the entire periphery thereof to surround the heat transfer surface 12, the liquid-noncontacted peripheral side surface of said gasket groove 13 being formed with gasket fixing portions 14 disposed at suitable intervals. The gasket fixing portion 14 comprises a convex portion 14*a* having a trapezoidal shape, concave portions 14*b* disposed on the opposite sides of said convex portion to communicate with the gasket groove 13 in the orthogonal direction, and a slit 14*c* formed in said convex portion to extend parallel with the gasket groove and communicate with said concave portions 14*b*. The numeral 15 denotes a gasket made of an elastic material such as synthetic rubber having heat resistance, comprising a gasket body 16 of substantially hexagonal cross section adapted to be fitted in said gasket groove 13. The liquid-noncontacted peripheral side surface of said gasket is integrally formed with U-shaped fixing tabs 17 corresponding to said gasket fixing portion 14 of the plate 11. The fixing tab 17 comprises projecting pieces 17*a* projecting orthogonally from the gasket body with the same spacing as that of the concave portions 14*b* of the gasket fixing portion 14 of the plate 1, and a fixing piece 17*b* formed on the front end of pieces 17*a* and extending parallel with the gasket body 16 and interconnecting the front ends of said projecting pieces 17*a*.

The gasket 15 is fixed to the plate 11 in that the gasket body 16 is fitted in the gasket groove of the plate 11 with the projecting pieces 17*a* of the fixing tab 17 loosely fitted in the concave portions 14*b* of the gasket fixing portion 14 which are wider than projecting pieces 17*a*, and with the fixing piece 17*b* of the fixing tab 17 force-fitted in the slit 14*c* of the convex portion 14*a*.

In the plate-type heat exchanger according to this first embodiment, since the gasket 15 is fixed to the plate 11 by loosely fitting the projecting pieces 17*a* of the fixing tab 17 in the wider concave portions 14*b* of the gasket fixing portion 14 of the plate 11 and force-fitting the fixing piece 17*b* of the fixing tab 17 in the slit 14*c* of the convex portion 14*a* of the gasket fixing portion 14, the fixing tab 17 of the gasket 15 can be fixed in parallel with the gasket groove 13 and with versatility in the parallel direction, and at the fixing position of the fixing tab 17 of the gasket 15 with respect to the gasket fixing portion 14 of the plate 11, lateral positioning freedom is provided in the direction parallel with the gasket body 16. Thereby, even if a scatter in the length of the gasket body 16 of the gasket 15 occures during manufacture of the gasket 15, the raising of the gasket body 16 from the gasket groove 13 and the fixing tab 17 being fitted in the bent state in the gasket fixing portion 14 of the plate 11 can be accommodated in a desired place or prevented by simply shifting the fixing position of the fixing tab 17 of the gasket 15 with respect to the gasket fixing portion 14; thus, the operability for fixing the gasket 15 in the gasket groove 13 of the plate 11 is improved and so is the sealing quality. Further, since the U-shape of the fixing tab 17 of the gasket 15 increases the bending strength of the fixing tab 17 with respect to the gasket body 16, the gasket body 16 can be prevented from rising or shifting from the gasket groove 13 and the operability for fixing the gasket 11 in the gasket groove 13 can be improved. Further, interference which tends to take place during manufacture and handling of gaskets 15 can be prevented to facilitate handling. It is also possible to increase the break strength of the fixing tabs 17 to decrease defective units.

Figure 5:
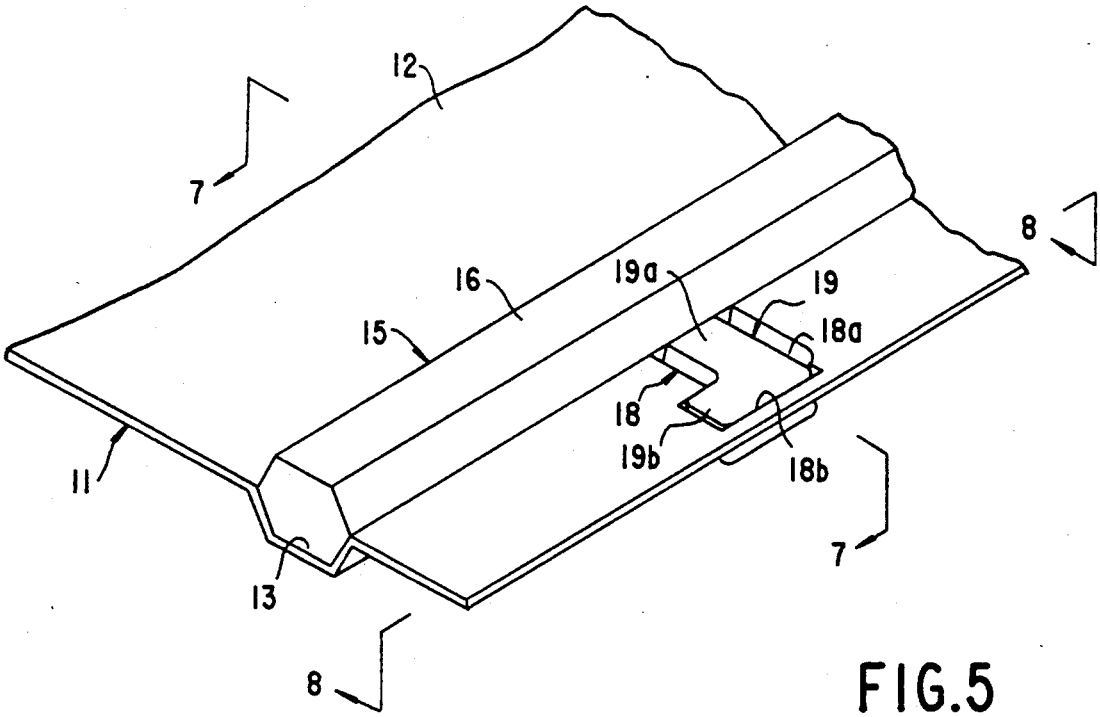
FIGS. 5 through 8 show a second embodiment of the invention.
Figure 6:
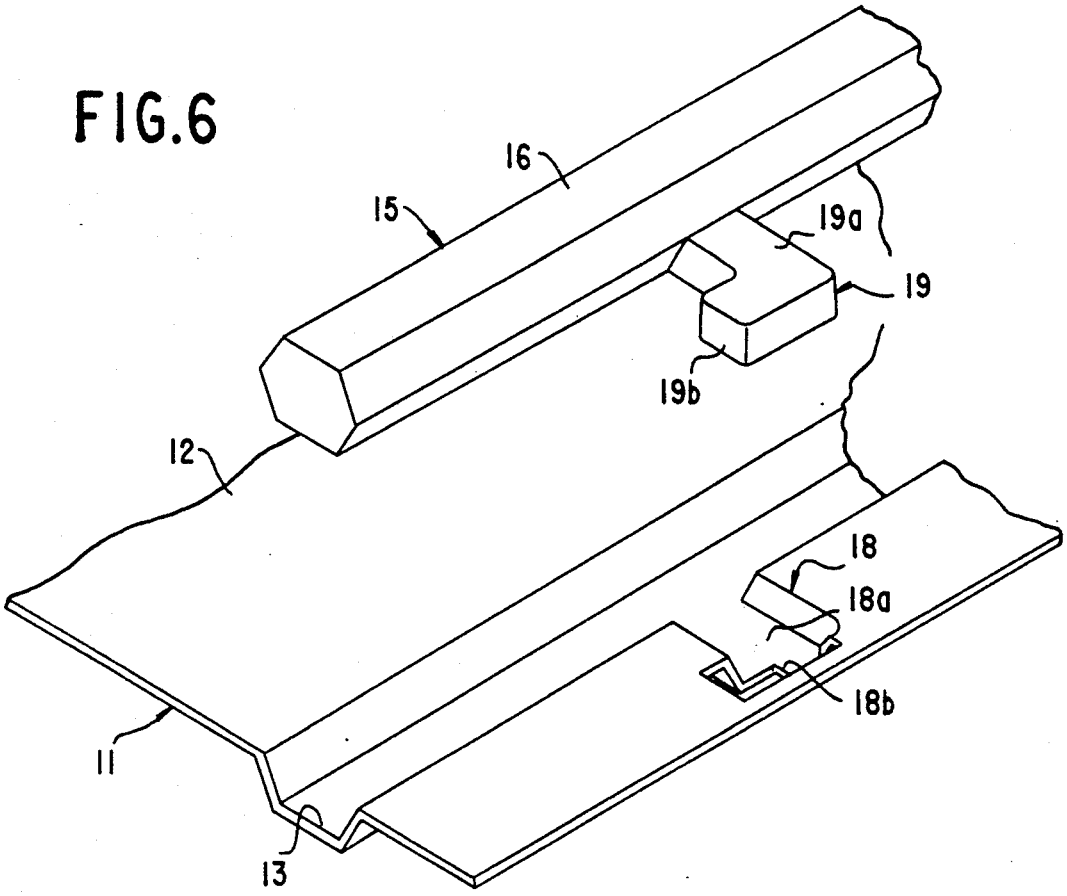
Figure 7:
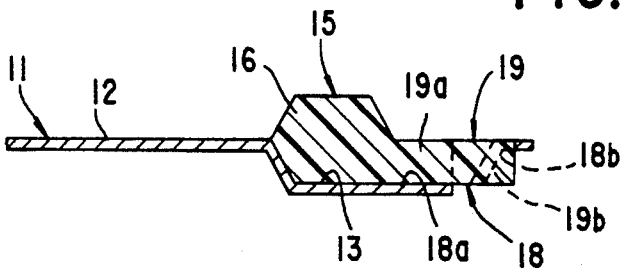
Figure 8:
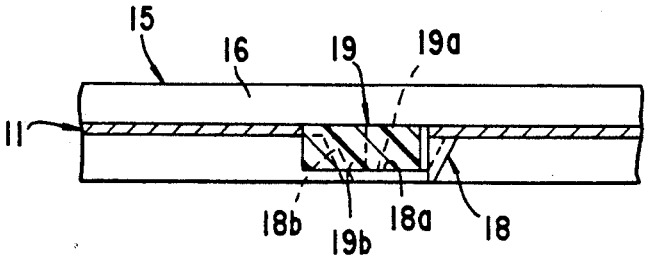
Figure 9:
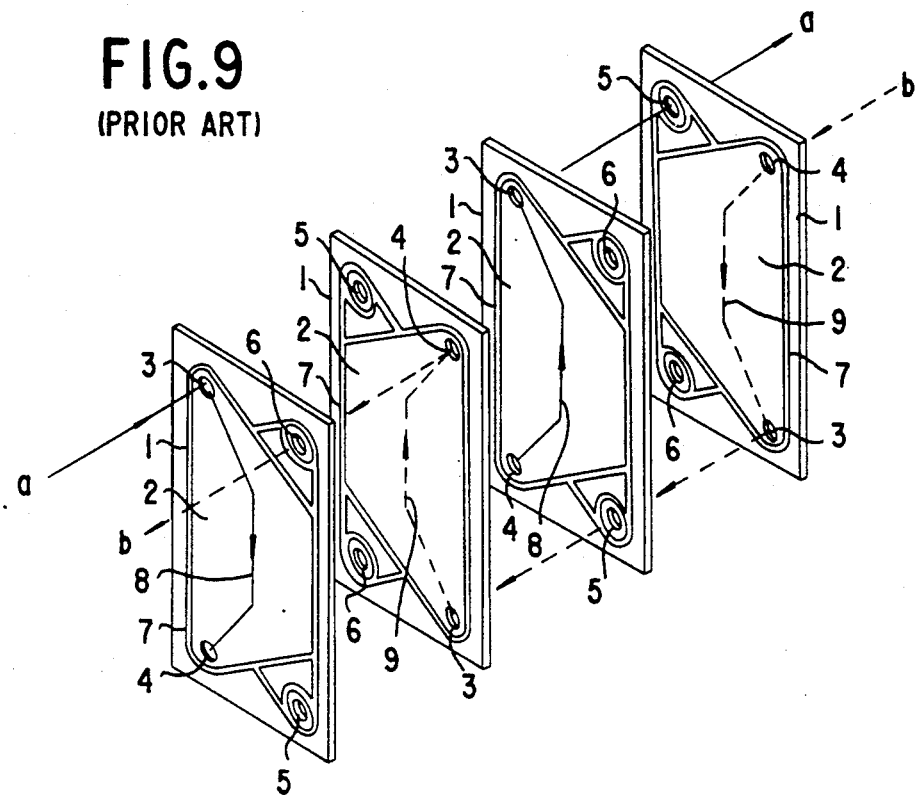
FIG.9 (PRIOR ART)
FIG. 9 is a fragmentary exploded perspective view showing an example of a plate-type heat exchanger plate.
Figure 10:
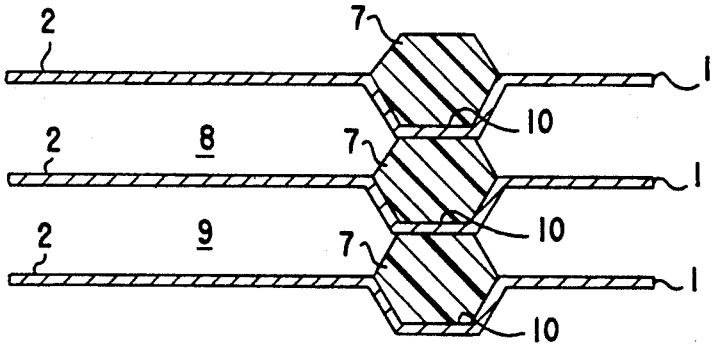
FIG.10 (PRIOR ART)
FIG. 10 is a sectional view of such plates as laminated.
Figure 11:
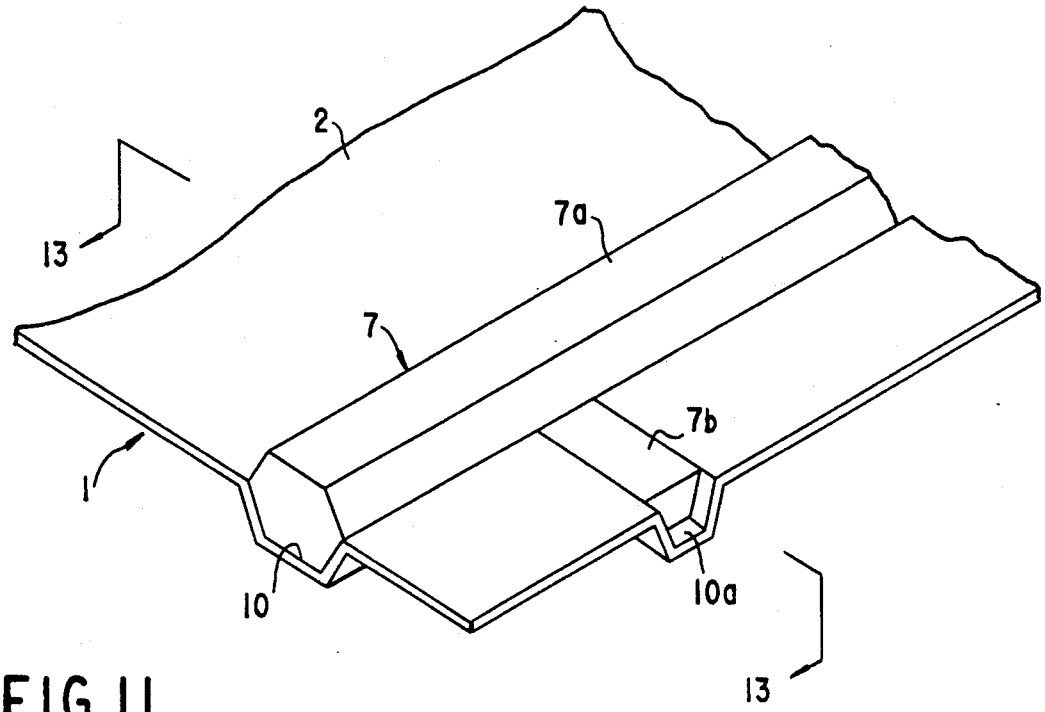
FIG.11 (PRIOR ART)
FIGS. 11 through 13 show a construction for fixing a gasket in a conventional plate-type heat exchanger.
Figure 12:
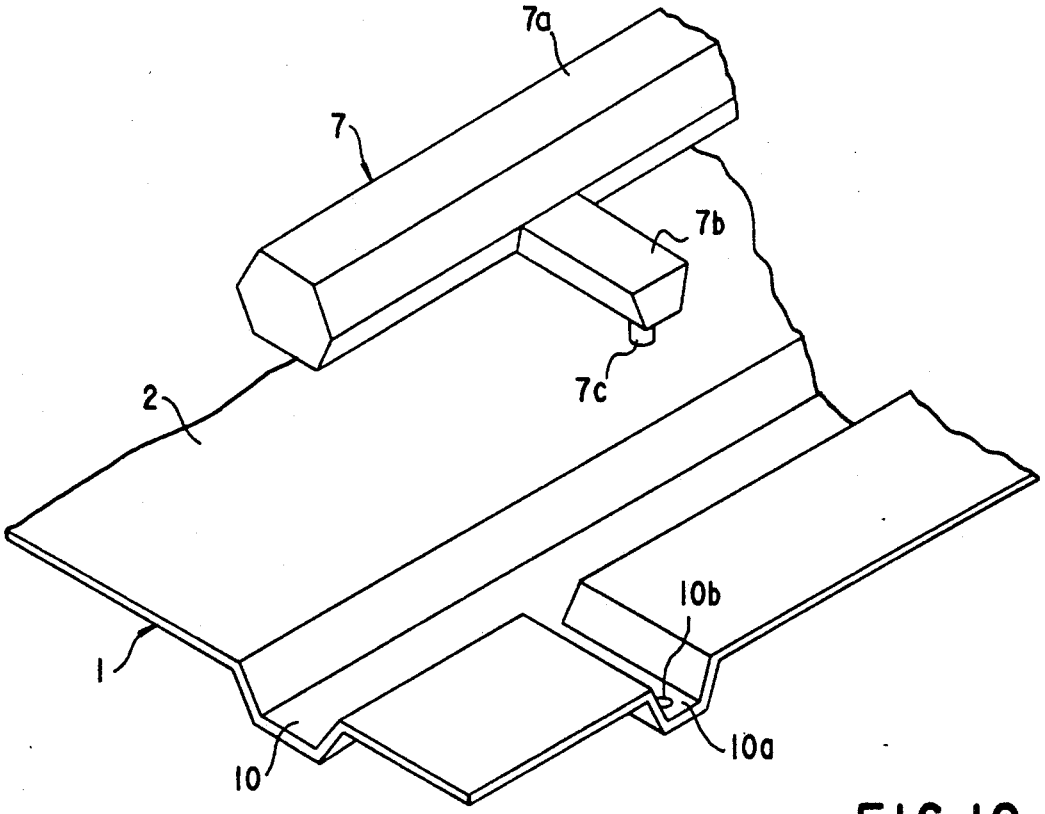
FIG.12 (PRIOR ART)
Figure 13:
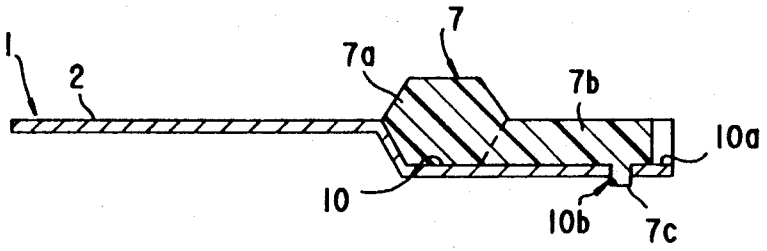
FIG.13 (PRIOR ART)
Figure 14:
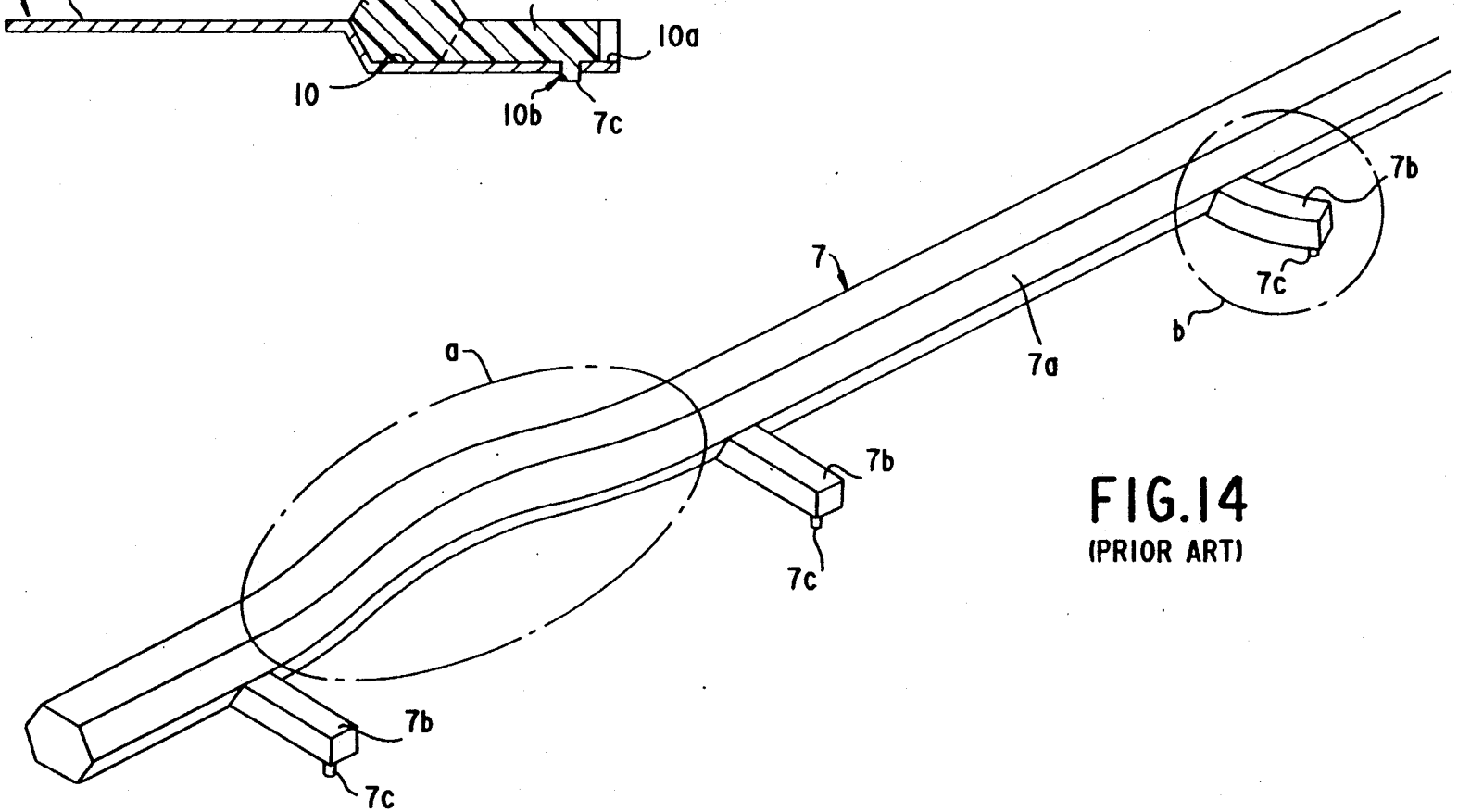
FIG.14 (PRIOR ART)
FIG. 14 is a fragmentary perspective view of a gasket showing occurrence of a drawback in a conventional gasket fixing construction.

FIGS. 5 through 8 show a second embodiment of the invention. FIG. 5 is a fragmentary perspective view showing a construction for fixing a gasket in a plate-type heat exchanger according to the second embodiment of the invention; FIG. 6 is an exploded perspective view thereof; and FIGS. 7 and 8 are sectional views taken along the lines 7—7 and 8—8 in FIG. 5, respectively. The same parts as those in the first embodiment are marked with the same reference characters to omit a description thereof.

In the second embodiment, the liquid-noncontacted peripheral side surface of the gasket groove 13 of the plate 11 is formed with gasket fixing portions 18 at suitable intervals, each gasket fixing portion comprising a concave portion 18*a* orthogonally communicating with said gasket groove 13 and a slit 18*b* disposed at the end surface and a side surface of said concave portion and extending parallel with the gasket groove 13. The liquid-noncontacted peripheral side surface of the gasket body 16 of the gasket 15 is integrally formed with L-shaped fixing tabs 19 associated with said gasket fixing portions 18 of the plate 11, each fixing tab 19 comprising a projecting piece 19*a* integrally and orthogonally projecting from the gasket body 16, and a fixing piece 19*b* integrally formed on the front end of said projecting piece 19*b* and extending parallel with the gasket body 16. The gasket body 16 of the gasket 15 is fitted in the gasket groove 13 with the projecting piece 19*a* of the fixing tab 19 of the gasket 15 loosely fitted in the wide concave portion 18*a* of the gasket fixing portion 18 and with the fixing piece 19*b* of the fixing tab 19 force-fitted in the slit 18*b* of the gasket fixing portion 18, whereby the gasket 11 is fixed to the plate 11.

In the plate-type heat exchanger according to this second embodiment, the fixing tab 19 of the gasket 15 can be fixed in parallel relation to the gasket groove 13 of the plate 11 and with versatility in the parallel direction and freedom can be imparted to the parallel direction of the gasket body with respect to the fixed position of the fixing tab 19 of the gasket 15 with respect to the gasket fixing portion 18 of the plate 11. Thus, the same functions and merits as in the first embodiment can be obtained.

Embodiments of the present invention have so far been described. However, the invention is not limited to these embodiments; they may be modified within the scope of the invention. For example, in the first embodiment, the fixing tab 17 of the gasket 15 has been described as having two projecting pieces 17*a* interconnected at their front ends by a fixing piece 17*a*; however, three or more projecting pieces 17*a* may be interconnected to provide a required fixing force. In that case, the gasket fixing portion 14 of the plate 11 will be constructed correspondingly thereto. Further, it is not necessary that the slits 14*c* and 18*b* of the plates be opened throughout their heights.

What is claimed is:

1. A plate-type heat exchanger comprising a plurality of plates (11) laminated through gaskets fixed in gasket grooves (13) formed in an entire peripheral edge thereof without using any adhesive agent, said plate-type heat exchanger comprising:

gaskets (15) each including a gasket body (16) having a liquid-noncontacting peripheral side surface integrally formed with a plurality of integrally formed spaced fixing tabs (17, 19), each comprising a projecting piece (17*a*, 19*a*) orthogonally projecting from said gasket body, each said projecting piece being formed at an end thereof with at least a fixing piece (17*b*, 19*b*) extending parallel with said gasket body (16); and said gasket grooves of said plates being formed with gasket fixing portions (14, 18) spaced corresponding to said spaced fixing tabs (17, 19), each gasket fixing portion having a concave portion (14*b*, 18*a*) formed wider than said projecting piece of said gasket to loosely accommodate said projecting piece with lateral positioning freedom therefor, and slits (14*c*, 18*b*) disposed in said plates at an end surface of each said concave portion and extending parallel with said gasket body (16) and formed to accommodate a fixing piece (17*b*, 19*b*) force fitted therein to affix the gaskets to the plates.

2. A plate-type heat exchanger according to claim 1, wherein each said fixing piece interconnects a plurality of projecting pieces.

3. A plate-type heat exchanger according to claim 2, wherein each said fixing piece interconnects two adjacent projecting pieces.

4. A plate-type heat exchanger according to claim 1, wherein said fixing tabs are L-shaped, each comprising a projecting piece projecting from said gasket body and a fixing piece extending parallel with said gasket body.

* * * * *